United States Patent [19]

Drelinger

[11] Patent Number: 4,800,635

[45] Date of Patent: Jan. 31, 1989

[54] METHOD OF MANUFACTURING FLUTE HEADJOINTS

[76] Inventor: Sanford Drelinger, 13 Park Cir., White Plains, N.Y. 10601

[21] Appl. No.: 795,201

[22] Filed: Nov. 5, 1985

Related U.S. Application Data

[62] Division of Ser. No. 468,894, Feb. 23, 1983, Pat. No. 4,550,637.

[51] Int. Cl.[4] ..... B29D 17/00

[52] U.S. Cl. ..... 29/169.5; 29/527.6; 164/35; 164/246

[58] Field of Search ..... 29/169.5, 527.6, 527.5; 164/34, 35, 246; 84/383 R, 384, 385 R, 386, 382, 380 A, 380 C

[56] References Cited

U.S. PATENT DOCUMENTS

| | | | |
|---|---|---|---|
| 1,432,279 | 10/1922 | Christensen | 29/169.5 |
| 1,792,928 | 2/1931 | Reigart | 29/169.5 |
| 1,805,449 | 5/1931 | Gulick | 84/382 |
| 2,255,301 | 9/1941 | Thompson | 29/527.6 |
| 3,561,905 | 2/1971 | Linton, Sr. | 84/380 |
| 4,048,709 | 9/1977 | Deem | 29/527.6 |
| 4,154,282 | 5/1979 | Kull | 164/34 |
| 4,557,312 | 12/1985 | Gonzales | 164/34 |

*Primary Examiner*—P. W. Echols

*Attorney, Agent, or Firm*—Emmanuel J. Lobato

[57] ABSTRACT

A mold is made from a flute chimney model having a precision bore, and a chimney is cast from the mold with substantially no shrinkage in bore diameter. The mold can be made from a chimney model having an entire undercut surface thereon, and the chimney cast with substantially no shrinkage in undercut diameter.

7 Claims, 6 Drawing Sheets

FIG. 3
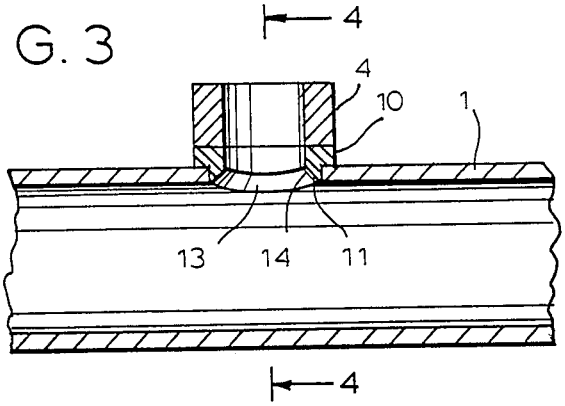
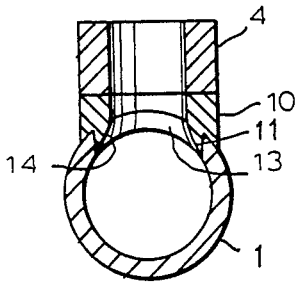
FIG. 4
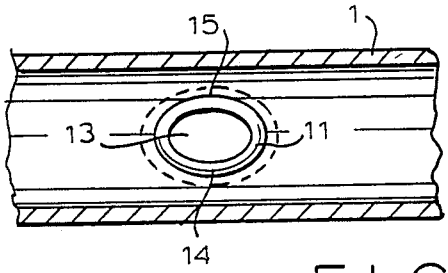
FIG. 5
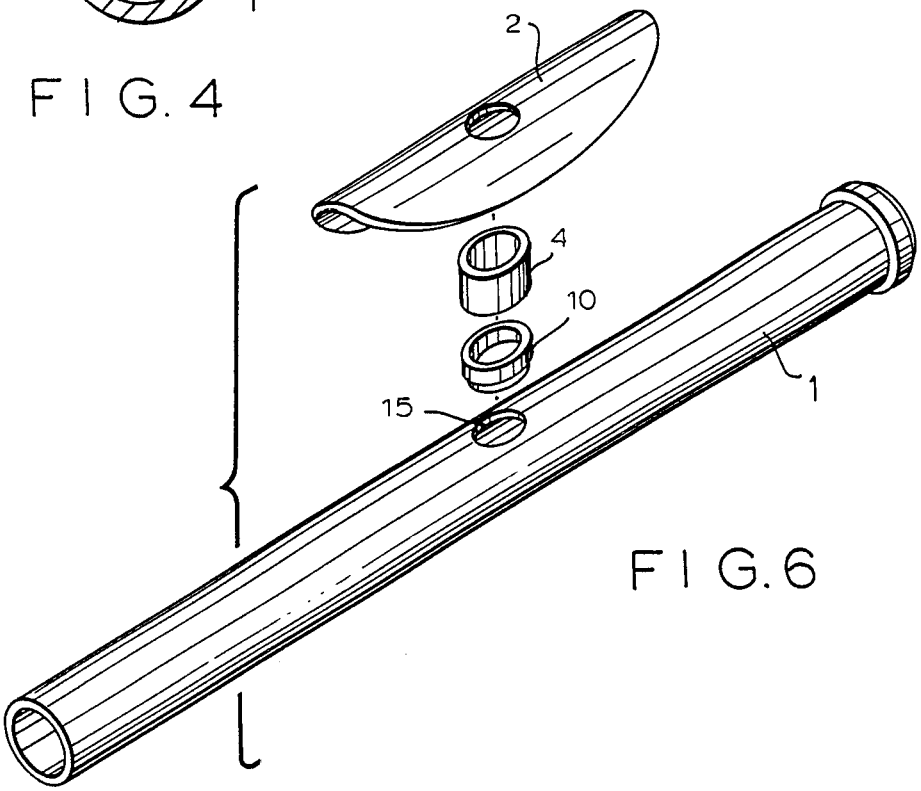
FIG. 6

FIG. 8
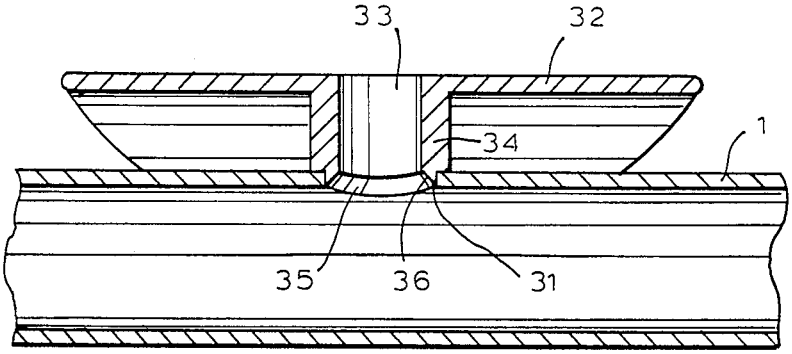
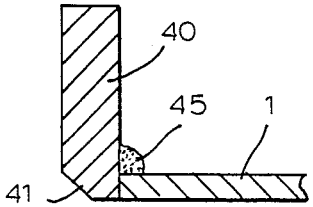
FIG. 9
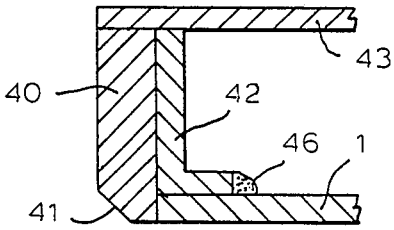
FIG. 10
FIG. 11
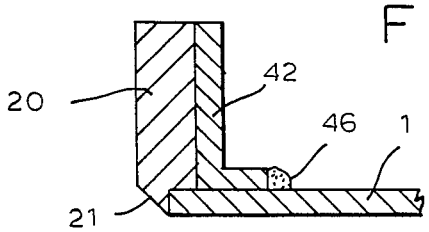

METHOD OF MANUFACTURING FLUTE HEADJOINTS

This is a division of application Ser. No. 468,894, filed on Feb. 23, 1983, now U.S. Pat. No. 4,550,637.

BACKGROUND OF THE INVENTION

The present invention relates to a method of manufacturing an improved flute headjoint having a replaceable lip plate, and more particularly a method of replicating high quality flute headjoints.

As used in this specification and the appended claims, the term "flute" includes all thin wall flutes, piccolos and other members of the flute family. A flute headjoint is that portion of the musical instrument of the flute family comprised of a length of tube having one closed end and one open end which is fitted to the main body having the tone holes and keys of the instrument. A lip plate having a hole therethrough is mounted on the side of the headjoint tube. A short length of tube, called a chimney, extends between the lip plate and the side of the headjoint tube. The lip plate hole, the chimney bore, and a hole through the side of the headjoint tube define an air passage between the lip plate hole and the interior of the headjoint tube. This passage is called the blow hole.

High quality flute headjoints have a tonal quality determined by manufacturing techniques which are largely empirical. High quality headjoints, which are made by master craftsmen, are very expensive.

The tonal quality of a headjoint is determined, to a large measure, by the geometry of the blowhole of the headjoint. The end of the chimney which is fixed to the headjoint tube (hereafter referred to as the base of the chimney) is finished by removing some material from the inner wall of the chimney at the chimney base opening. Material is also removed from the hole through the headjoint tube side wall so there is a smooth transition from the chimney bore surface to the headjoint tube inner wall surface. This portion of the chimney bore and headjoint tube inner wall from which material has been removed is referred to as the "undercut". Thus, the path of air into a flute during playing is through the lip plate hole, through the chimney bore and out through the opening in the tube comprising the undercut and into the headjoint tube.

The undercut is formed, using hand or machine tools, after the chimney and lip plate and headjoint tube are assembled. Typically, the lip plate, chimney and headjoint tube are permanently attached by soldering. Then the assembly person, (sometimes using a small mirror positioned within the headjoint tube and viewable through the lip plate hole) and using a hand held reamer or another machine or manual tool, removes material from the chimney wall and tube to form the undercut.

The prior art techniques used to form the undercut do not involve direct measurement of the undercut dimensions. Some artisans test the headjoint during the course of its fabrication, however, the validity of the test will depend upon his skill as a flutist. Others may have a flutist test the headjoint after it is complete. In either case, variability, lack of control and lack of repoducability resulting from the hand fabrication operations makes the manufacture of fine flute headjoints something of a hit or miss operation.

Additionally, conventional headjoints are difficult to modify. The chimney and lip plate are permanently attached by solder. The undercut is formed in the headjoint tube wall and in the chimney lower bore surface. Thus, replacement of the chimney would change the undercut. Modifications of the undercut structure are very difficult and expensive. And since the lip plate hole forms part of the blow hole, replacement of the lip plate may require modification of the undercut in order to "tune" the blow hole to the new lip plate.

Thus, retrofitting an existing headjoint with a new lip plate is extremely difficult. The geometry of the entire blow hole requires modification, including the undercut and the chimney bore. These modifications, of necessity, must be performed by hand working with all the drawbacks attendant thereto.

SUMMARY OF THE INVENTION

It is therefore an object of the invention to provide a method of manufacturing a headjoint in which the blow hole structure and lip plate can be easily replaced.

Another object of the invention is to provide a headjoint in which the blow hole structure can be easily modified.

Another object of the invention is to provide an improved method of manufacturing the undercut portion of flute headjoints.

Another object of the invention is to provide a method of customizing a flute headjoint to the requirements of an individual player.

Another object of the invention is to provide a method of replicating a headjoint.

An improved flute headjoint includes a headjoint tube having an alignment hole therethrough, and a tube section dimensioned for insertion into the alignment hole. The tube section includes a blow hole bottom opening and an undercut surface surrounding the blow hole bottom opening.

The tube section may be formed on the bottom of a headjoint chimney so that the chimney and tube section are one integral piece. The chimney bore is continuous with the blow hole bottom opening in the tube section.

A lip plate may be attached to the top of the chimney, and may be made integral therewith. An opening through the lip plate is continuous with the chimney bore and is the top opening of the blow hole.

Means releasably attaches the tube section to the headjoint tube.

According to the present invention, the tube section is made by casting. Likewise, the tube section and chimney can be made by casting, and the tube section, chimney and lip plate can be made by casting. If the casting mold is made from a model having dimensions derived from an original flute headjoint, then the manufacturing method is a replication method.

BRIEF DESCRIPTION OF THE DRAWINGS

FIG. 3 illustrates a transverse sectional view of the blow hole structure of a first embodiment of an improved flute headjoint;

FIG. 4 illustrates a cross-sectional view taken along the line 4—4 in FIG. 3;

FIG. 5 illustrates the blow hole bottom opening and surrounding structure of the improved flute headjoint;

FIG. 6 is an exploded view of the flute headjoint shown in FIG. 3;

FIG. 8 illustrates a transverse sectional view of the blow hole structure of a third embodiment of the improved flute headjoint;

FIGS. 9–11 illustrate different means for attaching the headjoint chimney to the headjoint tube;

DETAILED DESCRIPTION OF THE INVENTION

Figure 1:
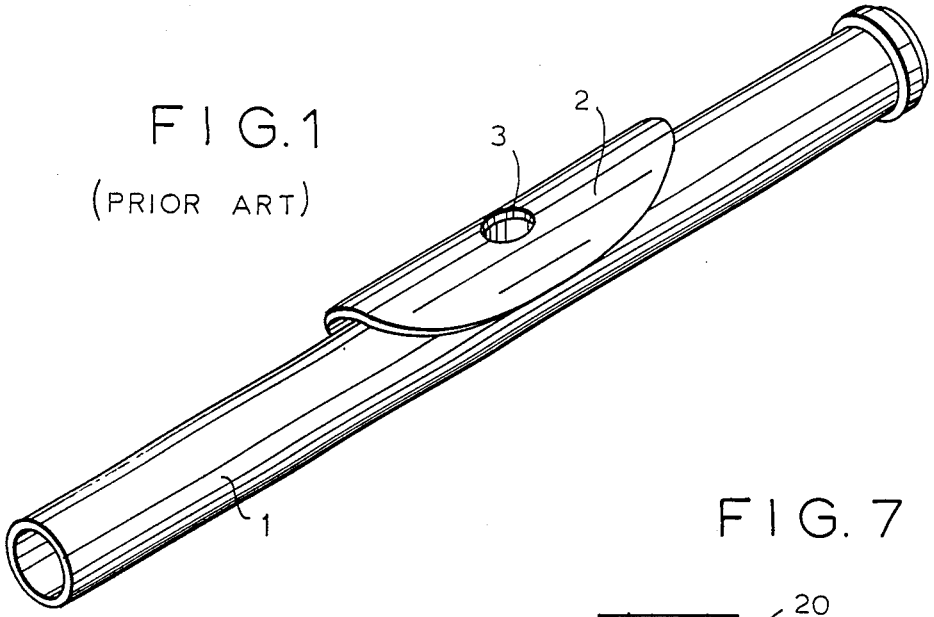
FIG. 1 (PRIOR ART)
FIG. 1 illustrates a conventional flute headjoint.

A flute headjoint shown in FIG. 1 is comprised of a headjoint tube 1 having a lip plate 2 mounted thereon. The lip plate 2 has a blow hole top opening 3. One end of the headjoint tube 1 is open and the other end is closed by a crown-cork assembly. The end portion of the headjoint tube 1 open end is called the tenon and fits to the rest of the flute body when the flute is assembled.

Figure 2:
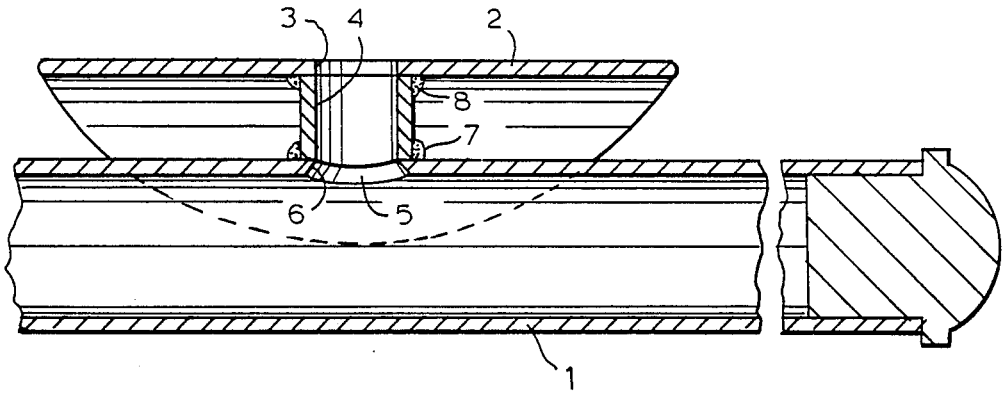
FIG. 2 (PRIOR ART)
FIG. 2 illustrates a transverse sectional view of a conventional flute headjoint.

A longitudinal sectional view of the headjoint is shown in FIG. 2. The chimney 4 extends from the blow hole top opening 3 to the blow hole bottom opening 5 which is an opening through the headjoint tube side wall. The blow hole is the air passage defined by the blow hole top opening 3 through the lip plate, the bore through the chimney 4 and the blow hole bottom opening 5 through the headjoint tube side wall.

In order to create a smooth transition of air flowing through the blow hole into the headjoint tube, the inner wall surface of the headjoint tube 1 is cut away around the blow hole bottom opening 5 so that there is no sharp corner at the inner surface of the headjoint tube 1 at the blow hole bottom opening 5. The rounded inner wall surface around the blow hole bottom opening 5 is referred to as the undercut 6. A flute having a flute headjoint with a proper undercut will produce a clearer sound and will produce all octaves more uniformly.

The undercut 6 is formed by hand or machine by cutting or abrading. Conventionally, before the undercut is formed, the chimney 4 is permanently fixed to the headjoint tube 1 by a bead of solder 7, and the chimney 4 is permanently fixed to the lip plate by a bead of solder 8. The undercut 6 is then formed in the inner wall surface of the headjoint tube 1, and the bottom region of the chimney bore, and the resultant structure is a permanent assembly.

FIG. 3 illustrates a transverse section of an improved headjoint that is the subject of U.S. Pat. No. 4,550,637. A headjoint tube 1 has mounted thereon a chimney 4, and a lip plate (not shown) is mounted on the chimney 4. The chimney 4 is connected to a tube section 10 of the headjoint tube 1 which is removable from the headjoint tube 1. The headjoint tube 1 has a positioning and alignment hole which receives an annular protrusion 11 of the tube section 10 and correctly positions and aligns the tube section 10. The annular protrusion 11 forms a portion of the headjoint tube 1 side wall and has an opening 13 defining the blow hole bottom opening. The surface surrounding the opening 13 defines the entire undercut surface so that undercut 14 is part of the tube section 10 and is not a part of the headjoint tube 1. The headjoint tube 1 is free of undercut surface.

FIG. 4 is a transverse cross section of the improved headjoint and illustrates how the annular protrusion 11 completes the inner surface of the headjoint tube 1.

FIG. 5 illustrates a transverse sectional view of the headjoint tube 1 showing the blow hole bottom opening 13 and the undercut 14. The tube section 10 fills the positioning hole 15 and is aligned and positioned relative to the headjoint tube 1 by the positioning hole 15.

FIG. 6 is an exploded view showing the relationship between the headjoint tube 1 and the lip plate 2 and the chimney 4 and tube section 10.

Figure 7:
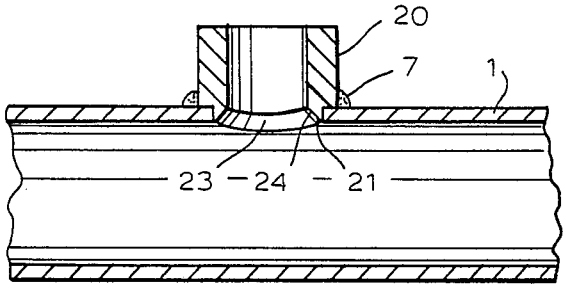
FIG. 7 illustrates a transverse sectional view of the blow hole structure of a second embodiment of an improved flute headjoint.

FIG. 7 illustrates a longitudinal section of a second embodiment of the improved headjoint in which the tube section and the chimney have been made as one integral piece. A chimney 20 has a bottom portion with an annular protrusion 21 which is inserted into the positioning and alignment hole through the side wall of the headjoint tube 1. The annular protrusion 21 forms a part of the inner wall surface of the headjoint tube 1 like in the embodiment illustrated in FIGS. 3 and 4.

The chimney 20 has a bore with an opening 23 defining the blow hole bottom opening. The undercut 24 is formed in the chimney 20 around the blow hole bottom opening 23, and no part of the undercut 24 is formed in the headjoint tube 1.

A third embodiment of the improved headjoint illustrated in longitudinal section of FIG. 8 comprises a lip plate, chimney and tube section made as one integral piece. A lip plate 32 has an opening 33 defining the top opening of the blow hole. A chimney 34 is integral with the lip plate 32 and the bore through the chimney 34 opens at the lip plate opening 33. A tube section 31 is formed at the bottom of the chimney 34, and the bore through the chimney 34 opens at the blow hole bottom opening 35. The undercut 36 is formed in the tube section 31 and smoothly merges the chimney bore into the blow hole bottom opening 35.

The different embodiments of the improved headjoint shown in FIGS. 3–8 all have a chimney bottom with an annular step for resting on the periphery of the positioning hole through the headjoint tube. However, the attachment between the chimney and headjoint tube can be made in other ways.

FIG. 9 illustrates an embodiment wherein the bottom of the chimney 40 is free of any stepped portion and defines a tube section 41. The chimney 40 is inserted through the positioning hole through the headjoint tube 1 so that the tube section 41 is flush with the wall inner surface of the headjoint tube 1. The chimney 40 is fixed to the headjoint tube 1 by a bead of solder 45.

FIG. 10 illustrates another embodiment wherein the chimney 40 is inserted through the positioning hole through the headjoint tube 1, and the entire chimney bottom 41 is formed as a tube section. However, in this embodiment, a sleeve 42 is attached to the headjoint tube 1 by a bead of solder 46. The sleeve 42 is dimensioned to receive the chimney 40 and to make a snug frictional fit with the chimney to hold the chimney and lip plate in position during playing. The height of the sleeve 42 is such that lip plate 43 rests on the top of the sleeve 42 when the tube section 41 is properly positioned relative to the wall inner surface of the headjoint tube 1. The sleeve 42 thus serves as a depth stop for the chimney 40. The chimney 40 and lip plate can be removed by hand and replaced by a different chimney and lip plate.

FIG. 11 shows still another embodiment which combines various previously illustrated and discussed features. The chimney 20 has a stepped portion which rests on the periphery of the positioning hole through the headjoint tube 1. A tube section 21 is formed at the bottom of the chimney. A sleeve 42 receives the chimney 20 with a snug fit to hold it in position during playing. As in the embodiment shown in FIG. 8, the chimney 20 and lip plate can be removed by hand and replaced by a different chimney and lip plate.

The embodiment shown in FIG. 11 has several advantages. By incorporating the step in the chimney bottom a better air seal is formed in order to minimize air leakage during playing. Additionally, the step in the chimney bottom determines the position of the tube section formed at the chimney bottom relative to the headjoint tube side wall inner surface. The sleeve therefore is not used as a depth stop so that chimneys of different height can be used with the same headjoint tube.

The element 10 having tube section 11, shown in FIG. 3, the chimney 20 and tube section 21 shown in FIG. 7, and the chimney 34 and integral tube section 31 and lip plate 32 shown in FIG. 8, can be made by casting using conventional casting techniques. Casting allows replication of an original lip plate, chimney, and undercut structure, hereinafter referred to as the "total structure". The dimensions of the cast piece molds can be determined by using precision computer aided measurements and machine tool techniques to measure the structure to be replicated, machine a model for making a mold, and to use the mold for casting the final product. However, the cost of the computer time for this process is extremely high.

Described below is a practical replication method for making a headjoint according to the present invention which is a replica of an original structure. For purposes of clarity, the headjoint selected for replication will be referred to as the original headjoint to be replicated, or simply the original headjoint, in the following description.

Figure 12:
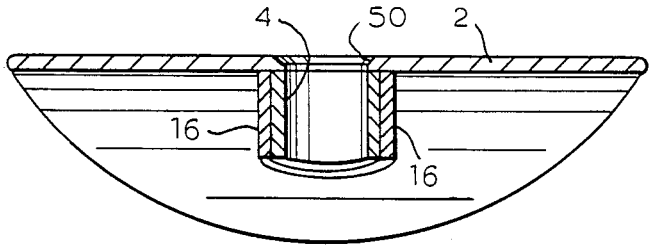
FIGS. 12–14 illustrate different structure which occur during the sequence of manufacturing steps for manufacturing the blow hole structure of the improved flute headjoint by the method according to the present invention.

First, the lip plate and chimney are removed as one piece from the original headjoint. All recesses are built up with a material to enable the resulting lip plate and chimney combination to serve as a model for a camless mold. The material sold under the trademark "Rapid Stone", or plaster of paris, is suitable for this purpose. FIG. 12 illustrates a cross section of the original lip plate 2 and the chimney 4 with built up portions 16 thereon. Material 16 has been built up on the outer surface of the chimney 4. The combination of the lip plate 2 and chimney 4 with the region 16 of material built up thereon is referred to as the first model.

A soft metal mold is made from the first model using the lost wax or hobbing process. Also, epoxy, silicon and other types of rubber molds, as well as dental impression techniques, can also be used with some alteration of techniques. For the purpose of this description, a metal will be considered a soft metal if it has a melting point less than approximately 200° C. This soft metal mold is the first mold used in the replication process.

Figure 13:
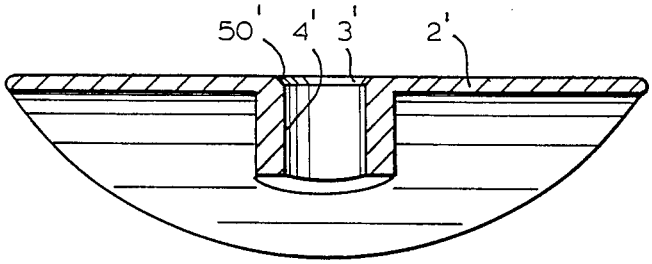
Figure 14:
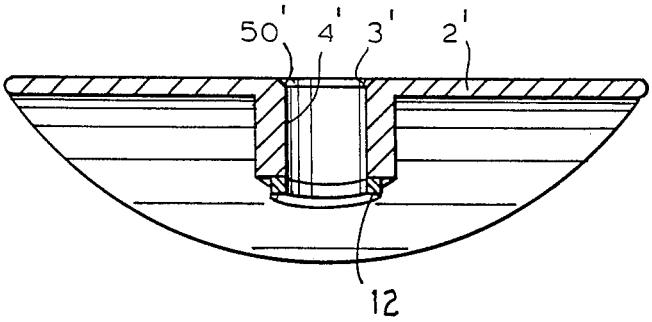

The first mold is then used to cast an integral lip plate 2' and chimney 4' by the lost wax process. The cast lip plate and chimney, illustrated in FIG. 13, will have generally the same shape and dimensions as the first model. More particularly, the dimensions of the blow hole top opening 3' will be substantially the same as those of the first model, as will the diameter of the bore through the chimney 4'. However, the height of the chimney 4' will have shrunk by about 0.01 inches (from 0.180 to 0.170) relative to the height of the chimney 4 of the first model. To compensate for the loss in height due to shrinkage, the base of the chimney is built up by an amount equal to twice the height loss caused by shrinkage, or about 0.02 inches. This can be done by electrodepositing 0.02 inches of metal onto the base of the chimney 4', and inside the bore of the chimney at the bottom portion thereof.

A new headjoint tube having a chimney positioning hole or alignment hole is provided. The alignment hole is through the side wall of the headjoint tube and serves a non-critical alignment function for the entire assembly comprising the tube section, the chimney and the lip plate.

An annular element 12 is attached to the base of the chimney 4' as shown in FIG. 4. The annular element 12 has at least a thickness equal to the thickness of the headjoint tube wall. The outer diameter of element 12 is equal to the diameter of the alignment hole, and the inner diameter is slightly smaller than the diameter of the bottom opening of the blow hole.

The cast integral lip plate and chimney, cast from the first mold with element 12 is attached to the headjoint tube. The material built up on the original lip plate and chimney is removed and they are reattached to the original headjoint tube to reassemble the original headjoint. The original headjoint is then suitably fixtured in a conventional manner, and the surfaces of original headjoint bore opening and undercut are traced by the sensor probe of a three-dimensional machine design computer which senses the shape of the traced surfaces, generates three-dimensional numerical position data defining the traced surfaces and stores the numerical surface position data in a computer memory.

The replicated total structure is also suitably fixtured in a conventional manner and the bottom bore opening and the tube inner surface is precision machined under control of the surface position data obtained from the measurements of the original headjoint to form the undercut. The precision machining operation is carried out with the cuts made in the longitudinal direction of the chimney relative to a coordinate system expanded by approximately 0.01 inches relative to the measured position values, to account for shrinkage that will occur in the final products.

After the undercut is formed, the integral lip plate and chimney is removed from the headjoint tube and is used to make a second mold. The second mold is made for molding the final production integral lip plate and chimney combinations. Because the second mold was made from a model having a chimney with an undercut sized in the length dimension of the chimney by an amount equal to the length lost due to shrinkage, the production articles cast from the second mold have undercuts which are exact replicas of the undercut of the original headjoint and which do not require further machining before use. The articles cast from the second mold require only cosmetic finishing before they are assembled with a new headjoint tube to form a completed headjoint.

Figure 15A:
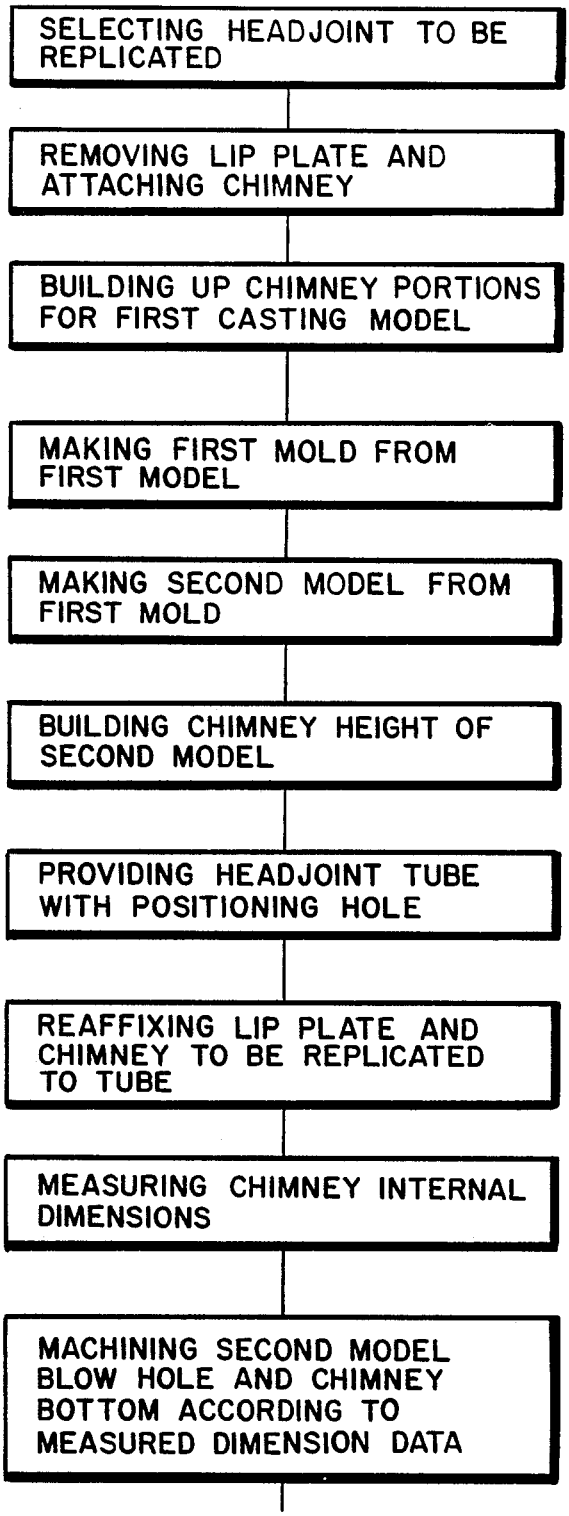
FIGS. 15A and 15B, and 16 illustrate the sequence of the steps of the method according to the invention for replicating a flute headjoint.
Figure 15B:
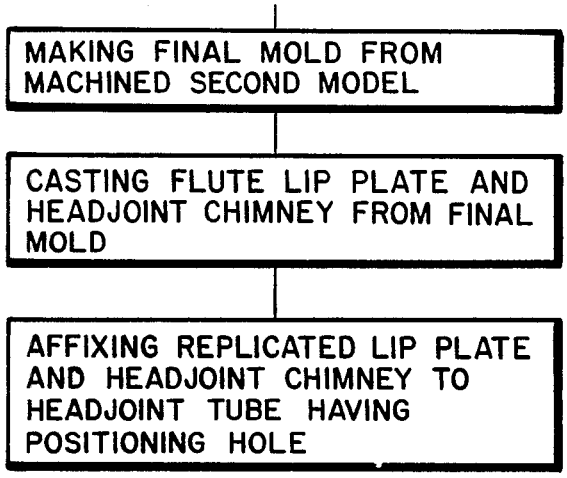
Figure 16:
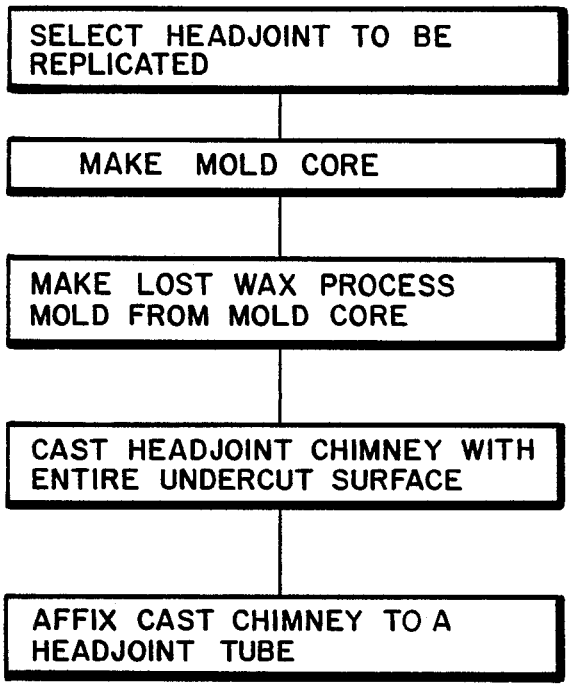

The complete sequence of method steps just described are illustrated in FIGS. 15A and 15B. They are summarized in FIG. 16 which shows the essential steps of the replication method according to the invention.

As an alternative method, if one is willing to use the original lip plate and chimney as a mold model, no intermediate casting steps are necessary. The original lip plate is built up and then machined to serve as the model for a final mold. In this case, a second headjoint is required in order to copy the undercut for controlling the machining operation.

Although the formation of the undercut has been emphasized, the rounded surface portion 50 surrounding the lip plate opening 3, called the overcut, is also critical to flute performance. An advantage of the replication method just described is that the overcut 50 is preserved in the subsequent models as overcut 50'. Accordingly, only the undercut need be reproduced by using te precision measuring and machining steps described above.

I claim:

1. A method of manufacturing a flute headjoint, comprising:

providing a flute headjoint tube;

casting a single piece comprised of a flute lip plate and chimney having an entire undercut surface at the chimney bottom opening and a bottom portion in the shape of an area of the headjoint tube, said bottom portion immediately surrounding the chimney bottom opening; and affixing the cast single piece to said flute headjoint tube.

2. A method according to claim 1, wherein the cast single piece has an annular stepped portion at the bottom of the chimney;

further comprising the step of providing a flute headjoint tube having an alignment hole dimensioned to receive the stepped end of the chimney; and wherein the step of affixing comprises inserting the stepped portion of the chimney into the alignment hole for forming a flute headjoint without handforming the undercut surface.

3. A method of replicating a flute headjoint, comprising:

(a) selecting a flute headjoint to be replicated;

(b) making a mold core in the shape of a flute headjoint chimney having an entire undercut surface at the bottom opening of the blow hole, wherein the mold core is shaped and dimensioned complementary to the blow hole and undercut of the flute to be replicated;

(c) making a mold for lost wax process casting from the mold core;

(d) casting a flute headjoint chimney having an entire undercut surface using the mold made in step (c); and (e) affixing the cast flute headjoint chimney to a headjoint tube to make a replica headjoint.

4. A method of replicating a flute headjoint according to claim 3, wherein the flute headjoint to be replicated has an undercut surface at least partially formed on the interior of the headjoint tube, and the replica headjoint has the entire undercut surface formed on the lower opening of the chimney of the replica headjoint.

5. A method of replicating a flute headjoint according to claim 4, wherein the flute headjoint chimney cast in step (d) includes a flute lip plate integral therewith.

6. A method of replicating a flute headjoint according to claim 3, wherein the flute headjoint chimney cast in step (d) includes a flute lip plate integral therewith.

7. A method of replicating a flute headjoint, comprising:

selecting a flute headjoint to be replicated, the flute headjoint to be replicated having a headjoint tube, a chimney attached to the headjoint tube, and a lip plate attached to the chimney with a blow hole extending through the lip plate, chimney and headjoint tube and opening at a bottom portion defining an undercut surface;

removing the lip plate and chimney in an attached condition from the headjoint tube;

building up portions of the chimney remote from the lip plate with a material to define a first model;

making a first mold from the first model comprised of the lip plate and chimney having the built up portions;

molding a second model of the lip plate and attached chimney to be replicated from the first mold;

building up the height of the chimney of the second model by adding material equal to approximately twice the height shrinkage between the first model and the second model;

providing a flute headjoint tube having a positioning hole;

removing the material from the lip plate and chimney to be replicated and reaffixing the lip plate and chimney to be replicated to the headjoint tube;

measuring the internal dimensions of the chimney to be replicated at least in the bottom portion thereof and storing the measured dimension data;

machining the blow hole of the chimney and the chimney bottom portion of the second model according to the stored dimension data to conform to the shape of the chimney to be replicated but to have a length dimension longer by an amount of the shrinkage of the headjoint chimney after a subsequent molding operation;

making a final mold from the machined second model for molding replicas of the original lip plate and chimney, wherein the final mold is dimensioned to account for shrinkage of the molded product in the length dimension of the chimney;

casting a flute replica lip plate and headjoint chimney using the final mold; and affixing the replica lip plate and headjoint chimney to the headjoint tube having the positioning hole with the chimney aligned with the positioning hole to complete the replicated headjoint.

* * * * *